United States Patent [19]

Abendschein et al.

[11] 4,073,603

[45] Feb. 14, 1978

[54] VARIABLE DISPLACEMENT COMPRESSOR

[75] Inventors: Frederic Henry Abendschein, Columbia, Pa.; John Saxon Ivey, Bloomfield Hills, Mo.; Richard W. Roberts, Lombard, Ill.; Dwight L. Tothero, York, Pa.

[73] Assignee: Borg-Warner Corporation, Chicago, Ill.

[21] Appl. No.: 655,799

[22] Filed: Feb. 6, 1976

[51] Int. Cl.[2] ..... F04B 1/26; F16H 23/08

[52] U.S. Cl. ..... 417/222; 417/270; 74/60; 417/269;270;222

[58] Field of Search ..... 92/12.1, 12.2, 13.7; 91/505; 74/60

[56] References Cited

U.S. PATENT DOCUMENTS

| | | | |
|---|---|---|---|
| 2,706,384 | 4/1955 | Schott | 74/60 |
| 2,964,234 | 12/1960 | Loomis | 74/60 |
| 2,980,025 | 4/1961 | Wahlmark | 417/218 |
| 3,319,874 | 5/1967 | Welsh et al. | 74/60 |
| 3,552,886 | 1/1971 | Olson | 417/269 |
| 3,861,829 | 1/1975 | Roberts et al. | 417/270 |

*Primary Examiner*—William L. Freeh
*Attorney, Agent, or Firm*—Thomas B. Hunter

[57] ABSTRACT

An axial piston, variable displacement, wobble plate gas or vapor compressor containing improvements in the capacity control system and in the drive plate and wobble plate mounting arrangements.

7 Claims, 22 Drawing Figures fig.3.
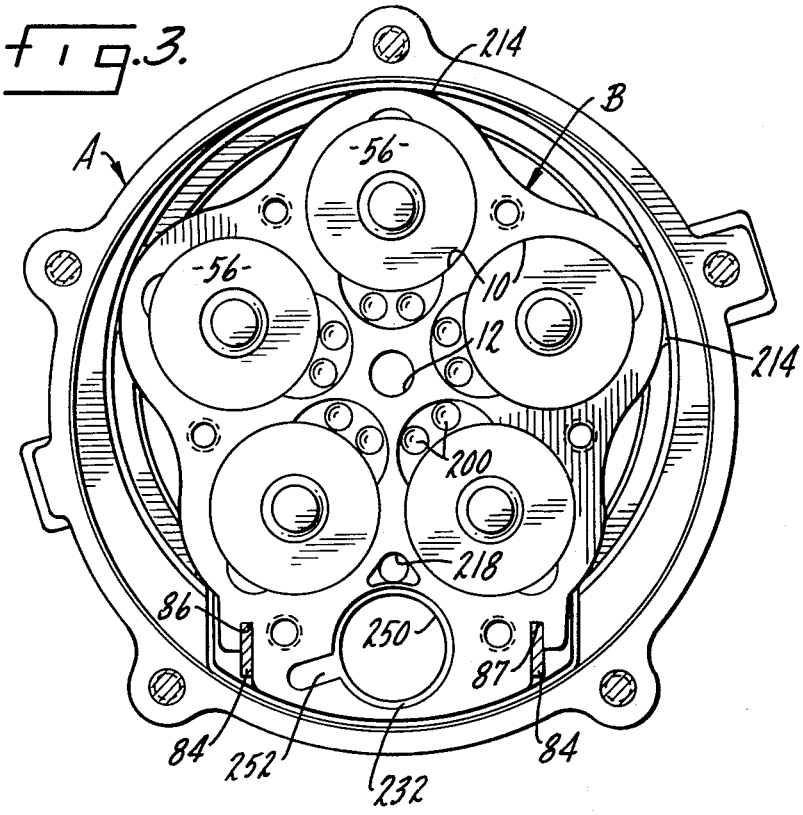
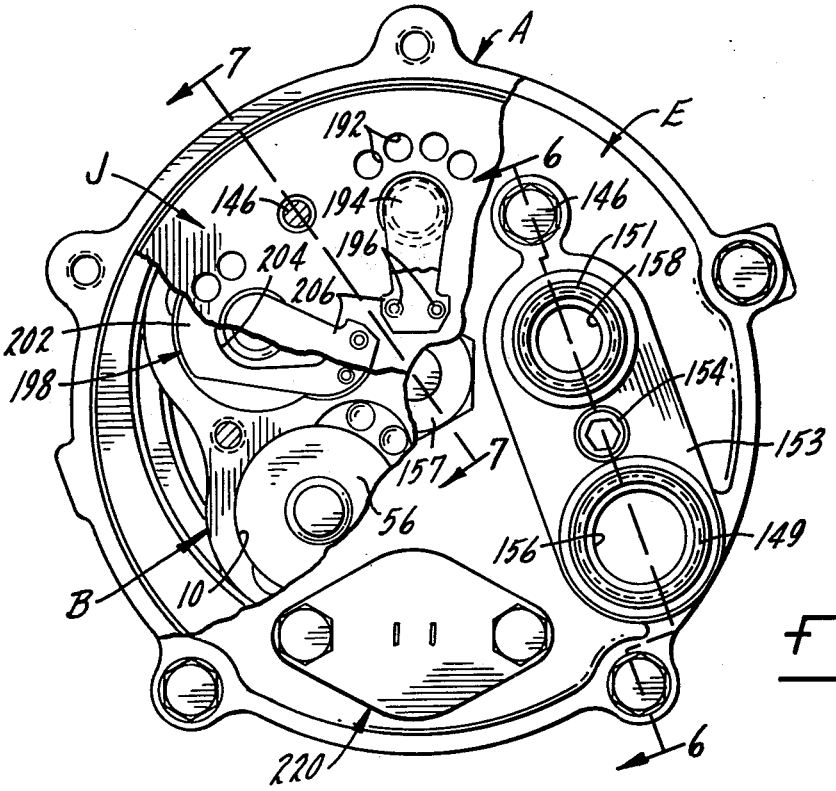
fig.2.

VARIABLE DISPLACEMENT COMPRESSOR

BACKGROUND OF THE INVENTION

1. Field of the Invention

Axial piston, wobble plate compressors of the type having a cam mechanism, adjustable to varying angles with respect to the drive axis, to control the stroke length of the pistons driven by said cam mechanism.

2. Description of the Prior Art

U.S. Pat. No. 3,861,829 (Roberts et al.), assigned to the same assignee as the present invention, describes a wobble plate compressor using controlled, under-piston gas pressure to vary the inclination of the wobble plate, which is supported on a universal joint. The present invention is an improvement on Roberts et al in that the drive mechanism is designed to reduce loads on certain critical elements, such as the pivot linkage, and to simplify the unit, making it more compact and easier to assemble.

U.S. Pat. No. 3,552,886 (Olsen) shows a spherical bearing or hinge ball supporting the drive plate/wobble plate assembly.

U.S. Pat. Nos. 2,980,025 (Wahlmark) and 2,964,234 (Loomis) both show the concept of pivoting the wobble plate assembly to a point spaced from the drive axis to maintain essentially constant clearance volume.

SUMMARY OF THE INVENTION

The present invention is directed to improvements in wobble plate compressors, especially those adapted for use in air conditioning apparatus, particularly for automotive applications.

A principal object of the invention is to provide a reliable variable capacity unit at a reasonable cost. One aspect of this objective has to do with an improved wobble plate and drive plate mount which permits torque loads to be transmitted independently of the pivot linkage which connects the driving member to the drive plate. Another aspect relates to the mechanism which anchors the wobble plate and still another to the balancing arrangement.

Many other advantages will be apparent from the description of the preferred embodiment which follows.

DESCRIPTION OF THE DRAWINGS

FIG. 2 is a rear elevation view, with portions of the head and valve plate broken away;

FIG. 3 is a view taken along the plane of line 3—3 of FIG. 1 with the control valve removed;

DESCRIPTION OF THE PREFERRED EMBODIMENT

For purposes of this description, the compressor may be regarded as being organized in a plurality of subassemblies. The mechanical parts are all disposed within a housing A which is generally cylindrical in cross-section and is provided with continuous side walls and opposed open ends into which the working parts are received. The other major subassemblies include a cylinder block B, a wobble plate C, a drive plate D, a head assembly E, the pistons and associated connecting rods F, capacity control unit G, drive shaft assembly H and valve plate J.

Figure 1:
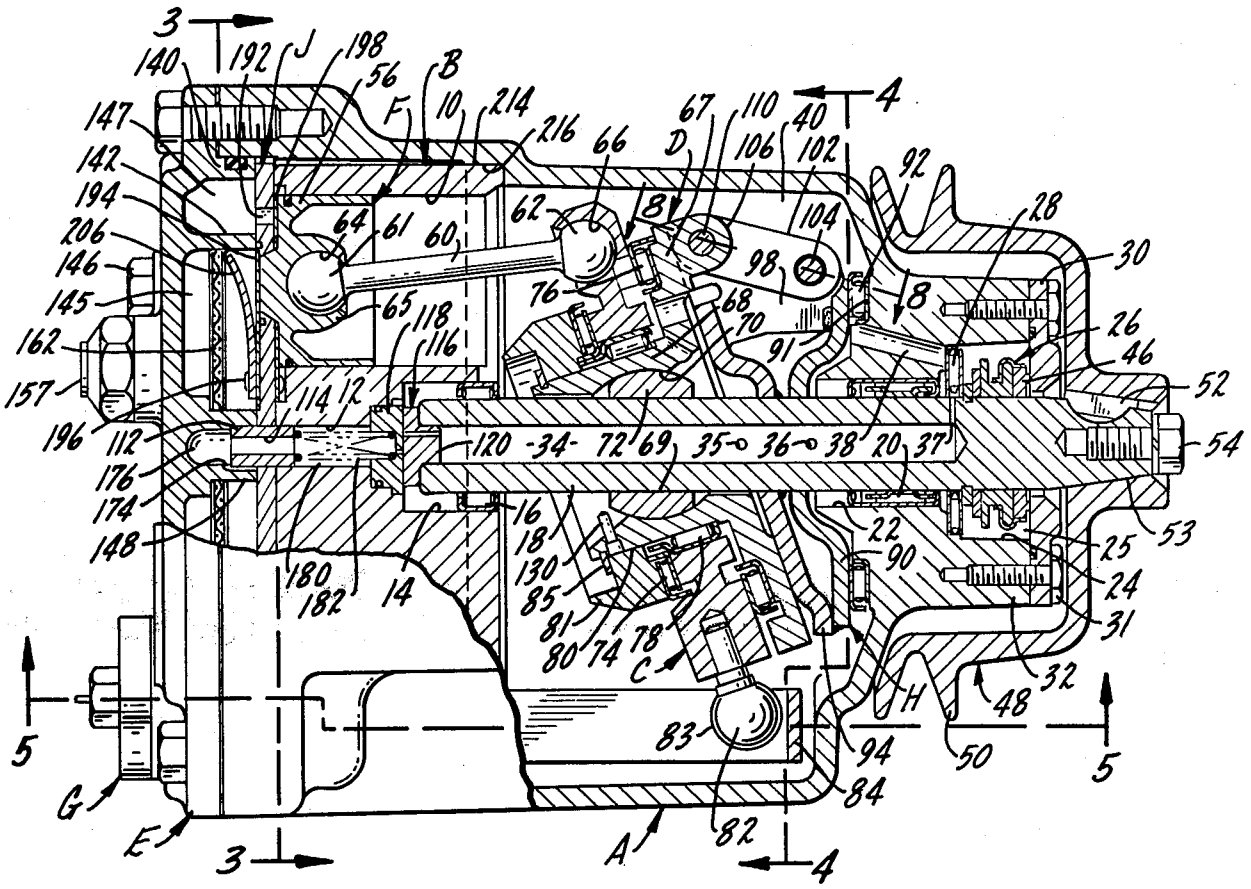
FIG. 1 is an elevation view, partly in cross-section, of a preferred embodiment of the present invention.

As best shown in FIG. 1, which is a cross section view, the cylinder block B is provided with a plurality of spaced cylinders 10. The axes of the cylinders are parallel to the drive shaft axis, but it is understood that it is possible to arrange such cylinders along nonparallel axes without departing from the principles of the invention. Also, while five cylinders are shown, the actual number is a matter of choice in design, although there is obviously some practical upper limit and the operation of the design shown requires at least three cylinders since the control of the wobble plate position depends on the balancing forces resulting from the geometry of the wobble plate pivot point with respect to the drive axis.

The cylinder block B also includes a centrally located axial bore 12 (as shown at the left hand side of FIG. 1) forming a part of the lubricant distribution system which is described in more detail below. There is also a counterbore 14 which receives the rear radial bearing 16, shown as the needle or roller bearing type. Radial bearing 16 supports the rear end of drive shaft 18. The terms "front", "rear" etc. are of course arbitrary; but in this description the front of the compressor is the right-hand portion of FIG. 1 and the rear of the compressor is the left-hand portion of FIG. 1.

The drive shaft 18 is supported at its front end by a front radial bearing assembly 20. The housing A is provided with a central axial bore 22 which receives the front radial bearing 20 and a counterbore 24 forming a cavity 25 adapted to accommodate a seal assembly 26 and the small thrust bearing 28. The right hand end (as viewed in FIG. 1) of the housing is closed by a seal plate 30 which is secured by a plurality of machine screws 31 threaded into the annular section 32 surrounding cavity 25 at the right hand end of the housing.

The drive shaft 18 has a central axial passage 34 which interconnects with a plurality of radial passages 35, 36 and 37 used to supply lubicating oil to the drive plate D, front radial bearing 20, the thrust bearings and other critical parts. There is also an inclined passage 38 through the right hand end of the housing which provides a path for lubricating oil and fluid communication between the interior of the housing and the seal cavity 25, said interior being identified by reference numeral 40 and sometimes referred to herein as the "crankcase". It should be noted that the crankcase is completely sealed except for the clearances between the pistons and the cylinder walls and the passages for oil flow through the drive shaft to the bearings etc. The seal assembly 26 at the right hand end of the drive shaft is fluid tight and designed to increase sealing as the pressure rises within the crankcase, as communicated to the seal and bearing cavity through passage 38. Sealing contact is made between the rotating seal element 46 and the inside surface of the seal plate 30.

The drive shaft is driven by means of a pulley 48 having a generally bell shaped configuration and provided with V-belt engaging flanges 50. The pulley is keyed at 52 to the tapered section 53 of the drive shaft 18 and held in place by a machine screw 54 at the end thereof. Although the compressor is described as being driven by a pulley, because one principal application for the compressor is in an automotive air conditioning system driven by the accessory drive belt, it should be understood that any suitable drive means may be provided.

The piston and connecting rod assembly F includes pistons 56 connected to the wobble plate C by means of connecting rods 60, each having ball shaped enlarged sections 61, 62 at opposite ends thereof which may be captured in sockets formed respectively in the pistons and wobble plate. As viewed in FIG. 1, the left hand end 61 of each connecting rod is secured to the underside of the pistons and received within a complementary shaped socket 64 formed in a thickened portion 65 of the piston 56 at the center thereof. The opposite ball shaped end 62 of the connecting rod is received within a complementary socket 66 formed in the wobble plate C. This arrangement allows a number of degrees of freedom, in all directions, between the respective ends of the connecting rods both at the piston and at the wobble plate.

Figure 21:
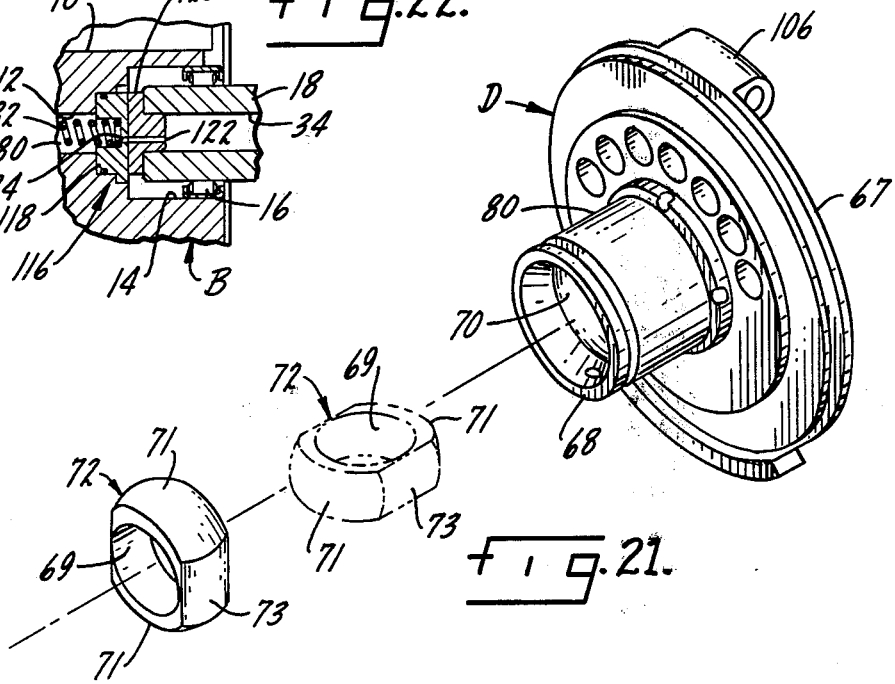
FIG. 21 is a perspective view of the drive plate assembly showing the hinge ball in different positions prior to assembly.

The wobble plate C is rotatably supported on the drive plate assembly D (see FIGS. 18–21) which includes an annular flange 67 extending radially from the drive shaft axis and an axial hub section 68 which is hollow and formed with an internal spherical surface 70 to receive the main wobble plate and drive plate bearing member, referred to herein as hinge ball 72. Hinge ball 72 is formed with a bore 69 for drive shaft 18, opposed spherical surfaces 71 and opposed cylindrical surfaces 73 to allow insertion into the hub section 68 as shown in FIG. 21.

The whole plate C is mounted for relative rotary movement with respect to the rotating drive plate assembly D by means of three sets of bearings: the rear wobble plate thrust bearing 74; the front wobble plate thrust bearing 76; and the radial wobble plate bearing 78. The inner race of the radial bearing 78 is mounted on the OD 80 of the axial hub section 68 of the drive plate assembly so that the drive plate, which acts as a cam mechanism, can rotate freely with respect to the wobble plate. In order to balance the assembly under dynamic conditions, a balance weight ring 81 of substantial mass is secured to the nose of the hub section 68 by means of retaining ring 85. The wobble plate C is restrained against rotative movement by means of anchoring ball element 82 and cooperating slippers or pads 83. When the compressor is in stroke, the anchoring ball slides back and forth within a U-shaped track 84 attached to the lower portion of the cylinder block B in slots 86 and 87 (see FIGS. 3 and 5).

The drive shaft assembly including plate H, which is secured to and rotates with the drive shaft, is formed from two stampings, the first of which (shown at 90) is spaced from surface 91 on the inside of the housing by means of a large thrust bearing assembly 92. A second section 94, which is inclined with respect to the drive shaft (at the same angle as the maximum inclination provided for maximum stroke operation of the compressor) is attached to the drive shaft 18, such as by welding, and also where it is in contact with the first stamping 90. Joining the two stampings at the top are a pair of spaced apart, rearwardly extending flanges 96, 98 (see FIG 8) which are adapted to support links 100, 102 connecting the drive plate assembly D to the drive shaft assembly H.

Figure 4:
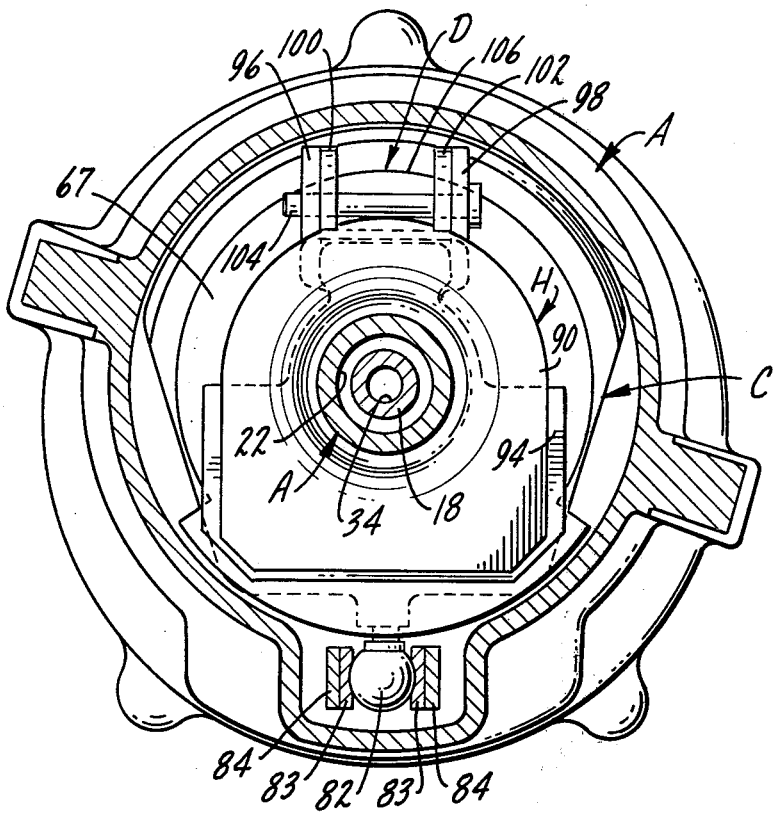
FIG. 4 is a view taken along the plane of line 4—4 of FIG. 1.
Figure 8:
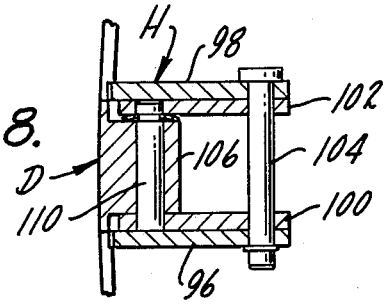
FIG. 8 is a cross-section view taken along the plane of line 8—8 of FIG. 1.

The improved mechanism for mounting the drive plate D for pivotal movement with respect to the drive axis and the link plate assembly H constitutes an important aspect of the present invention. This arrangement virtually eliminates all torque applied through the links 100 and 102 which, because of their relatively small size, are not suitable as drive transmission elements. As best shown in FIGS. 4 and 8, the flanges 96, 98 are joined to the front end of links 100, 102 by means of a pin 104, while the opposite end of each link is pivotally secured to a large lug 106 projecting from the front of the drive plate D by means of a pin 110. Since the links 100, 102 each have opposite faces in engagement with both the lug 106 on the drive plate and flanges 96, 98 on the link plate assembly, the torque is transmitted from flanges 96, 98 to the lug 106 on the drive plate without producing a bending moment on the links 100, 102.

Figure 22:
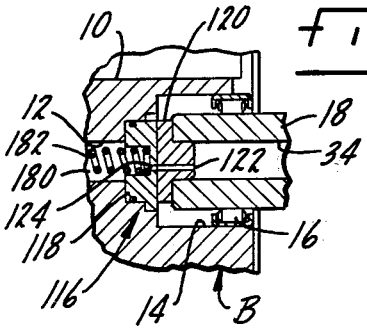
FIG. 22 is a detailed cross-section view of the lubricant flow interrupter assembly.

Although forming no part of the invention claimed herein (as it is the subject of Borg-Warner Case 073131-BWL filed concurrently herewith), another advantage of the compressor described herein is the fact that an oil pump is not required. Lubrication is accomplished by using discharge gas pressure as the driving force to circulate oil to the various bearings and seal assemblies which require a certain amount of lubrication for efficient operation. Oil is circulated through a hollow dowel 112 received within central bore 12 in the cylinder block B. Dowel 112 extends through the valve plate J and serves to accurately locate the valve plate and head, as well as the various gaskets, with respect to the cylinder block. From the passage 114 in dowell 112, the oil flows through an oil interrupter assembly 116 which includes a stationary section 118 and a rotating section 120. As best shown in FIG. 22, rotation of element 120 intermittently connects passage 122 in the stationary section with passage 124 in the rotating section, thus allowing flow of oil during the time the two passages are in registration with each other. This system controls the flow of the oil as it passes through the axial bore 34 through drive shaft 18 and then through radial passages 35, 36, and 37 to the front bearings and seal assembly. Without the interrupter, the oil return passage would permit an uncontrolled flow of discharge gas into the crankcase which would drive the wobble plate to the minimum stroke position and would make effective control of the displacement impossible to achieve.

As will be described in more detail below, the capacity control system G includes a valve member which controls the pressure maintained within the crankcase 40 and therefore the angle of inclination of the wobble plate and drive plate assemblies. The refrigerant vapor will flow by the piston rings to maintain a certain amount of pressure within the crankcase. High crankcase pressure acting on the underside of the pistons, by virtue of the articulated pivot point being spaced from the drive shaft axis, causes the drive plate and wobble plate to move toward the vertical position, decreasing stroke and capacity. Conversely, reduction in crankcase pressure will cause the wobble plate and drive plate assemblies to move toward a more inclined position, increasing stroke and capacity.

The wobble plate is never allowed to move completely to a zero stroke position; otherwise there would be no vapor admitted to the gas working spaces and therefore nothing for the pistons to react against in order to force the wobble plate to an inclined position. To insure the minimum stroke necessary a stop pin 130 is located in the drive plate 68. The stop pin will engage the drive shaft at a point such that a minimum of 1–2% of stroke will always be maintained.

Figure 6:
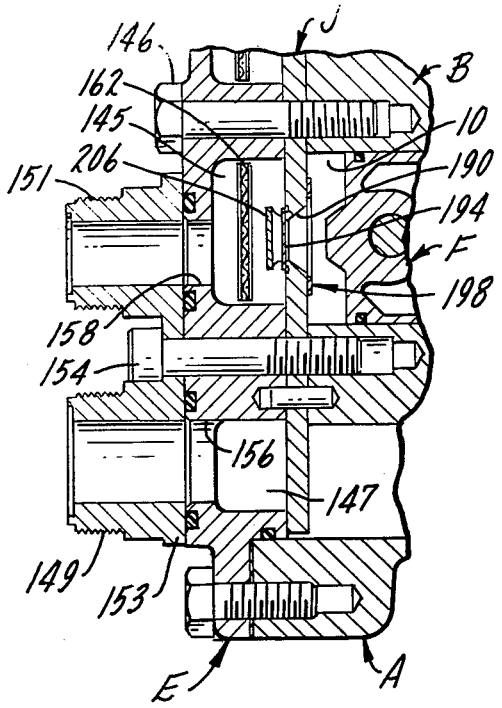
FIG. 6 is a cross-section view taken along the plane of line 6—6 of FIG. 2.
Figure 7:
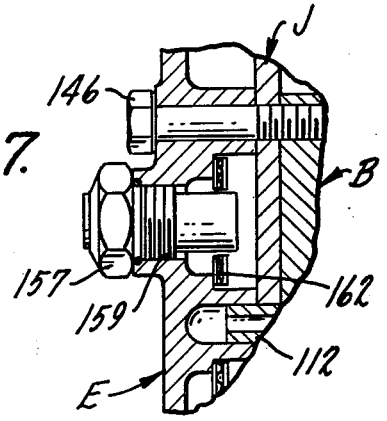
FIG. 7 is a cross-section view taken along the plane of line 7—7 of FIG. 2.
Figure 9:
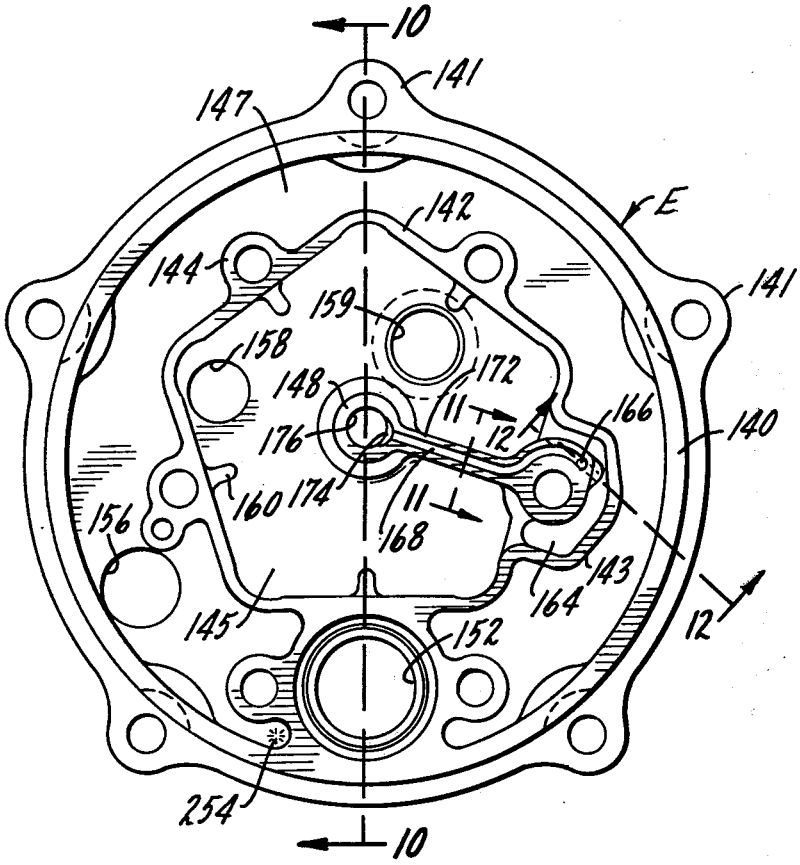
FIG. 9 is a plan view of the underside of the head assembly.
Figure 10:
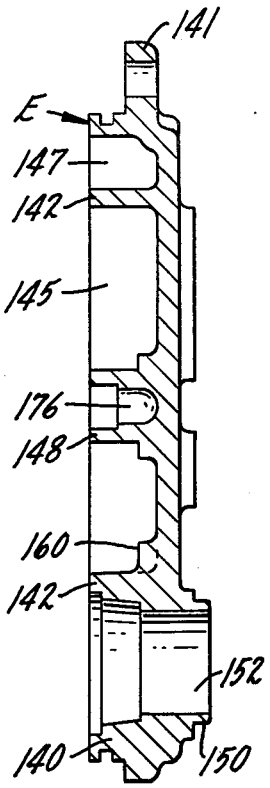
FIG. 10 is a cross-section view taken along the plane of line 10—10 of FIG. 9.

As best shown in FIGS. 9 and 10, which are, respectively, a bottom plan view looking at the underside of the head E and a cross-section view, the perimeter thereof is bounted by a downwardly extending skirt portion 140 which is adapted to seat against a similarly shaped gasket (not shown) between the head and the valve plate J. Lugs 141, for attaching the head to the housing, extend from the edge thereof. Disposed inwardly from the skirt is a generally pentagonally shaped rib 142 having a series of lugs 144 thereon, through which the head bolts 146 extend, a U-shaped section 143 which forms a collector or sump for oil separated from the discharge gas, and a central boss 148 for receiving the hollow dowel 112 (FIG. 1). It is also provided with a generally circular boss 150 which bridges one of the skirt side walls and rib 142 to provide a housing for the solenoid valve assembly 220, which is seated in bore 152. It should be noted at this point that the inner rib 142 separates the discharge or high pressure region 145 from the suction or low pressure region 147. Suction gas is admitted through port 156 into the outer region between the peripheral wall 140 and the interior wall 142, while discharge gas flows outwardly through discharge gas port 158 located at the upper left hand side of the interior section bounded by rib 142. See also FIGS. 2, 6 and 7. A port 159 for a standard pressure relief valve is located in the high pressure region. On the outside surface of the head are the exterior connections for the suction and discharge lines. As shown in FIGS. 2 and 6, a mounting plate 153 is bolted to the head at 154. Projecting from the mounting plate are threaded connector fittings 149, 151 for the suction and discharge gas lines respectively. The high pressure relief valve 157 (FIG. 7) extends through port 159 into the high pressure plenum. It is well understood, if the compressor is used in an air-conditioning or refrigeration application the discharge line would connect to a condenser, an expansion device, an evaporator and the suction line, in series flow relation.

Figure 11:
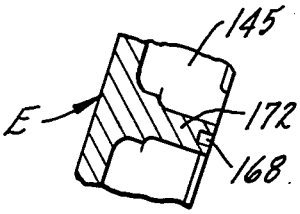
FIG. 11 is a partial cross-section view taken along the plane of line 11—11 of FIG. 9.
Figure 12:
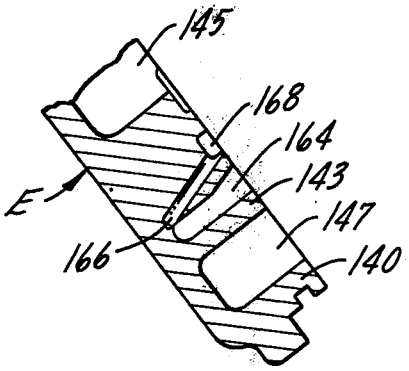
FIG. 12 is a partial cross-section view taken along the plane of line 12—12 of FIG. 9.
Figure 13:
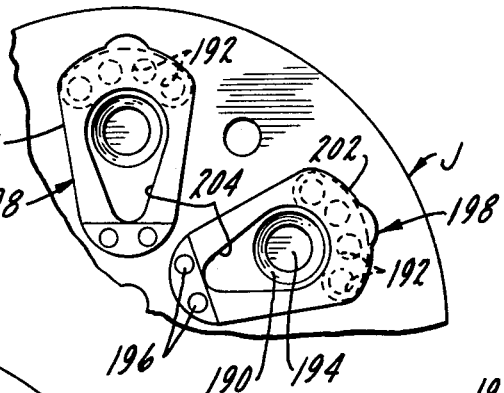
FIG. 13 is a detailed view of the suction and discharge valve assembly as viewed from underneath the valve plate.

The head assembly has a series of inwardly projecting lugs 160 which support an oil separator screen 162 (see FIGS. 1, 6 and 7) constructed of a mesh or screen-type material, between the valve plate 114 and the head in the high pressure region. A substantial portion of the lubricating oil coalesces on the screen as it flows into the discharge zone bounded by rib 142 and drains by gravity into a pocket shaped area 164 defined by wall section 143, which, although shown in FIG. 9 at the four o'clock position, will actually be the lowest point within the interior of rib 142 when the compressor is oriented properly. As best shown in FIG. 12, which is a cross-section view taken along the plane of line 12—12 of FIG. 9, there is a drilled hole 166 communicating with the lower portion of the oil collecting pocket 164 and there is a shallow groove 168 (see also FIG. 11) which is formed in a rib 172 extending from the pocket 164 to the boss 148 through which the hollow dowel extends. The groove 168 provides a channel for lubicating oil running from the pocket 164 to a crescent shaped relief section 174 cut in the interior wall of the central boss 148. From there it flows into a small chamber 176 (FIG. 1) adjacent the dowell 112 and then through the bore 114 to the space 180 between the dowel and the stationary flow interrupter element 118. The latter is fixed within a counterbore and urged axially to the right by means of the spring element 182 against the mating surface of the rotating oil interrupter element 120. As best shown in FIG. 22, these elements have passages 122, 124 which are spaced from the drive axis at the same radius. As passage 124 in the rotating interrupter element 120 comes into registration with the passage 122 in the stationary element 118 a small quanity of oil will flow to the axial bore 34 in the drive shaft 18 and then through the series of radial ports in the drive shaft, as earlier described.

Figure 14:
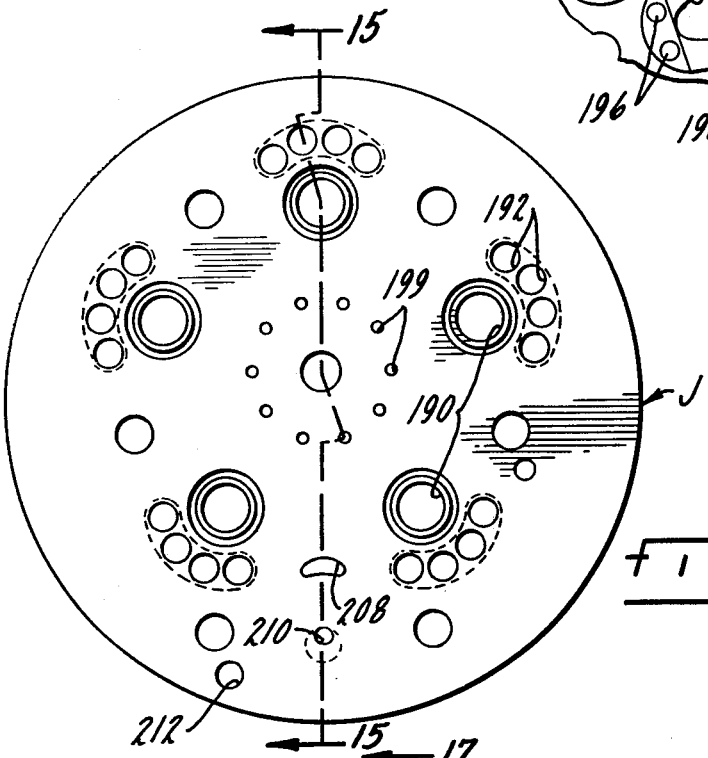
FIG. 14 is a plan view of the valve plate.

The construction of the valve plate J and associated suction and discharge valves is best shown in FIGS. 2, 13, 14 and 15. Referring to FIG. 14, the valve plate has a series of discharge ports 190 which communicate with the discharge zone 145 defined by the interior rib 142 of the head. A series of suction ports 192, are spaced radially outwardly from the discharge ports and communicate with suction region 147. Reed or flapper-type discharge valves 194 are secured to the top surface of the valve plate by rivets 196 which also hold suction valves 198 on the bottom of the valve plate.

Since the rivets extend through holes 199 below the bottom surface of the valve plate, a plurality of dimples 200 are formed in the top surface of the cylinder block to accomodate them. The suction valves 198, (FIG. 13) which are formed with an arcuate section 202 overlying the suction ports 192 at the bottom surface of the valve plate, include a large elongated opening 204 in the center thereof to allow flow of gas to the discharge port 190. The discharge valves are furnished with individual valve stops 206 (FIG. 1) which limit the upward travel of the valves.

Figure 15:
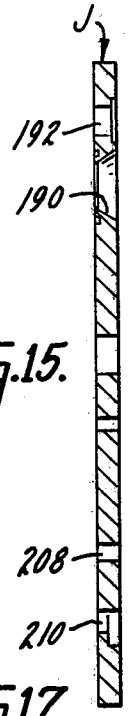
FIG. 15 is a cross-section view of the valve plate taken along the plane of line 15—15 of FIG. 14.

In FIG. 14 it will be noted that the valve plate is also provided with a small kidney shaped port 208, port 210 directly underneath it and another port 212 to the left of port 210 (FIGS. 14 and 15). These ports form part of a gas flow path related to operation of the capacity control valve G. The details of this arrangement will be described below.

Figure 16:
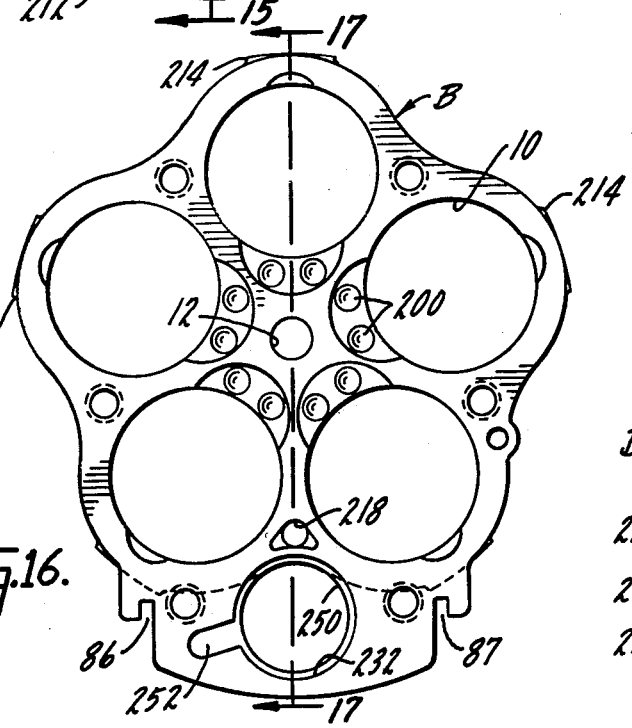
FIG. 16 is an elevation view of the cylinder block as viewed away from the valve plate.
Figure 17:
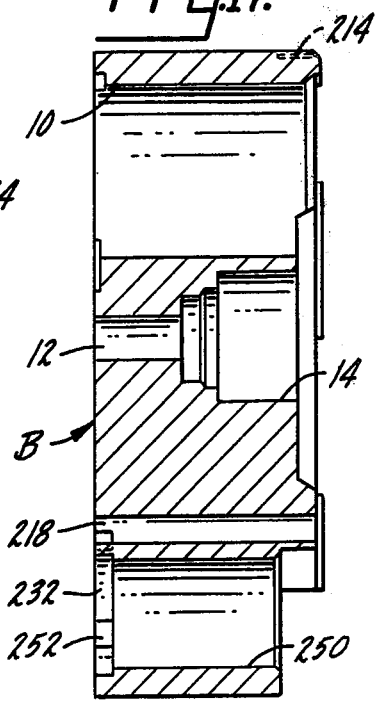
FIG. 17 is a cross section view taken along the plane of line 17—17 of FIG. 16.
Figure 18:
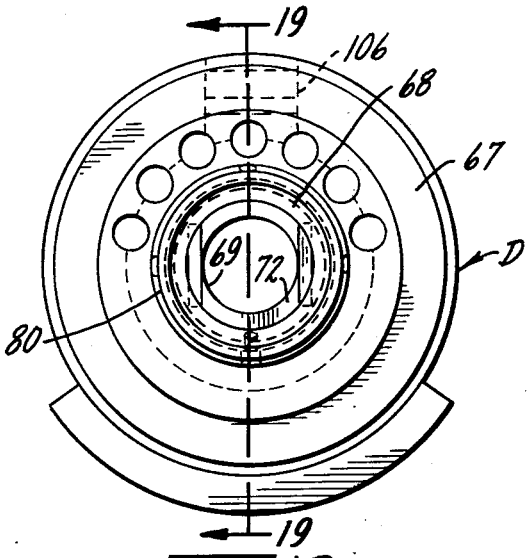
FIG. 18 is a plan view of the drive plate assembly.
Figure 19:
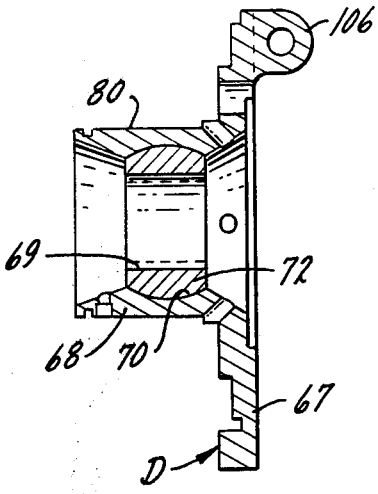
FIG. 19 is a cross-section view of the drive plate assembly along the plane of line 19—19 of FIG. 18.
Figure 20:
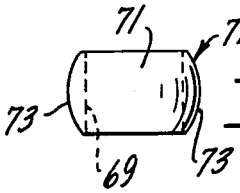
FIG. 20 is an elevation view of the hinge ball.

The cylinder block, as best shown in FIGS. 16 and 17 has a number of convex lands 214 which engage the machined inside surface 216 of the housing A. The five cylinders 10 are equally spaced from each other, radially and circumferentially. A passage 218 parallel to the cylinder axis, extends through the cylinder block and registers with the kidney shaped opening 208 in the valve plate mentioned above. This passage transmits pressure existing with the crankcase 40 through the valve plate to a region which is on one side of the capacity control port 210 in valve plate J and can be closed by the solenoid valve 220 (see FIG. 5).

Figure 5:
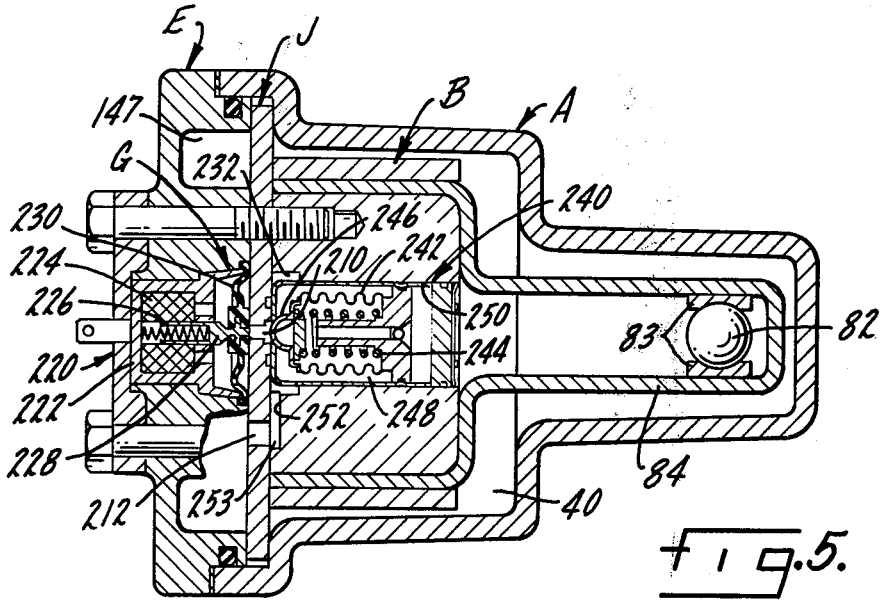
FIG. 5 is a cross-section view taken along the plane of line 5—5 of FIG. 1.

As best shown in FIG. 5, solenoid valve 220 includes a housing 222, a coil 224 and an armature 226. The armature is connected to a valve member 228 located in the central region of a diaphragm 230. When the coil is energized, the armature moves to the left pulling the valve member and uncovering control port 210. When de-energized, the diaphragm forces the valve member to the right, closing the port 210. When the solenoid valve is open, crankcase pressure is transmitted through passage 218 and port 208 into a circular chamber 232 between the diaphragm and the top surface of the valve plate adjacent to control port 210.

A suction responsive control valve 240 controls flow from the crankcase to the suction cavity (when the solenoid valve is open) and includes a sealed evacuated bellows 242 biased by spring 244 and a valve member 246 adapted to seat against the control port 210. Suction pressure is transmitted to the chamber 248 surrounding the bellows in the following manner.

With reference to FIG. 16, the bore 250 in cylinder block B (which receives the suction pressure control valve 240) is associated with a relieved area or undercut surface 252 (FIGS. 5, 16 and 17). This area forms a gas passage 253 between the valve plate and the block extending from port 212 in the valve plate, which is in registration with the distal portion thereof, to chamber 248 surrounding bellows 242. Port 212, in turn, is in registration with the suction plenum 147 in the head and is located at a point designated by 254 at (*) in FIG. 9, just to the left of bore 152.

The higher pressure crankcase gas thus flows along the following path: from crankcase 40 through passage 218, diaphragm chamber 232, control port 210, bellows chamber 248, passage 253, port 212 and into the suction plenum at point 254.

OPERATION

It will be assumed that, initially, the compressor is in its full stroke operation, substantially as depicted in FIG. 1.

As the pulley 48 is driven, torque is transmitted to the drive shaft 18. The link plate, connected to the drive shaft will rotate and the flanges 96, 98 transmit the torque through the links 100, 102 to the drive plate without producing a bending moment on the links. As the drive plate rotates, it acts as a cam driving the wobble plate in a nutating path. The anchor ball 82 slides back and forth in track 84 as pistons reciprocate in cylinders 10.

As described in the aforementioned Roberts et al. U.S. Pat. No. 3,861,829, the crankcase pressure, created by gas blowing by the pistons, is modulated to control the angle of the drive plate and therefore the length of stroke. The geometry of the pivot points of the links 100, 102 with respect to the drive axis is such that an increase in crankcase pressure will act against the underside of the pistons, and the resultant force will cause the wobble plate to move to a more vertical position, decreasing stroke length and capacity. Conversely, a decrease in crankcase pressure will allow the force of the gas in the working spaces to move the wobble plate to a more inclined position, increasing stroke length and capacity.

Thus by controlling crankcase pressure, the capacity of the compressor may be precisely controlled in response to some external variable; in this case, suction pressure. Assume now that the solenoid valve 220 is open and some predetermined suction pressure exists. Since this suction pressure is enveloping the bellows, as previously described, the position of the bellows valve member responds to suction pressure. If the suction pressure should rise, due perhaps to an increase in the load, the bellows contracts opening valve member 246. This allows more gas to flow through port 210 from the crankcase to suction, decreasing the crankcase pressure and increasing stroke length. If suction pressure drops, indicating reduced load, the bellows will expand because of spring 244 and reduce flow through port 210 from the crankcase to suction. This, of course, will increase crankcase pressure reducing stroke length and capacity. The solenoid valve is basically an on-off control. When de-energized, it will close port 210 causing the crankcase pressure to rise and thus move the wobble plate to minimum stroke position. The stop-pin will not permit zero stroke and there will be permitted just enough reciprocation of the pistons to admit some gas to the working spaces, to maintain some flow of oil through the system, and to maintain sufficient pressure differential across the compressor so that it will go into stroke when the solenoid valve is energized.

While this invention has been described in connection with a certain specific embodiment thereof, it is to be understood that this is by way of illustration and not by way of limitation; and the scope of the appended claims should be construed as broadly as the prior art will permit.

What is claimed is:

1. A compressor comprising means defining a plurality of gas working spaces each having a piston cooperating with suction and discharge ports to compress a fluid therein; a drive shaft; a cam mechanism driven by said drive shaft; a wobble plate driven by said cam mechanism in a nutating path about the drive shaft axis; means operably connected between said wobble plate and the individual pistons to impart reciprocating drive to said pistons, the length of stroke being a function of the angle at which said wobble plate is supported relative to the drive axis; means connected to said drive shaft including at least one axially extending flange member; lug means associated with said cam mechanism having a portion in spaced, juxtaposed relation with a surface on said flange; a pivot link attached at one end thereof to said flange and at the other end thereof to said lug means, said lug means being spaced from the axis of said drive shaft so that said cam mechanism is pivoted at a point not coincident with said drive shaft axis, there being no drive connection at the drive shaft axis between said cam mechanism and said drive shaft, said link being positioned between said flange and said lug means so that the torque is transmitted from said drive shaft to said cam mechanism without producing a substantial bending moment on said pivot link.

2. A compressor as defined in claim 2 including an anchoring ball attached to said wobble plate; and a track means receiving said anchoring ball for reciprocating motion to prevent rotation of said wobble plate with said cam mechanism, but still permit nutating motion thereof.

3. A compressor as defined in claim 1 including a balance weight ring carried by said cam mechanism, said balance weight ring being located so as to compensate for an unbalanced condition of said cam mechanism as its position is changed relative to the drive shaft axis.

4. A compressor comprising means defining a plurality of gas working spaces each having a piston cooperating with suction and discharge ports to compress a fluid therein; a suction plenum and a discharge plenum cooperating with said suction and discharge ports, respectively; a drive shaft, a cam mechanism driven by said drive shaft; a wobble plate driven by said cam mechanism in a nutating path about the drive shaft axis; means operably connected between said wobble plate and the individual pistons to impart reciprocating drive to said pistons, the length of stroke being a function of the angle at which said wobble plate is supported relative to the drive shaft axis; a housing providing a substantially fluid-tight crankcase enclosing said pistons and confining the fluid bypassing said pistons from said gas working spaces such that the fluid pressure in said crankcase is applied to the underside of each said piston to produce a force urging said wobble plate toward a plane normal to the drive shaft axis; means defining a fluid passage from said crankcase to said suction plenum; pressure control means for controlling the pressure in said crankcase, said means including a modulating valve means controlling the flow of fluid in said crankcase to said suction plenum through said fluid passage and a non-modulating valve means adapted to completely close off flow between said crankcase and said suction plenum causing an increase in pressure within said crankcase and thereby moving said wobble plate toward a zero-stroke position.

5. A compressor as defined in claim 4 including stop means for preventing said wobble plate to be moved entirely to its zero-stroke position, thereby insuring a minimum pressure differential between suction and discharge pressure.

6. A compressor as defined in claim 4 wherein said modulating valve means comprises a bellows actuated valve, the external portion of said bellows being responsive to suction pressure causing an increase in flow from said crankcase to said suction plenum upon an increase in suction pressure and a corresponding decrease in flow from said crankcase to said suction plenum upon a decrease in suction pressure.

7. A compressor as defined in claim 6 wherein said non-modulating valve means comprises a solenoid actuated valve adapted to substantially close fluid communication between said crankcase and said suction plenum and thereby cause an increase in fluid pressure in said crankcase.

* * * * *

UNITED STATES PATENT OFFICE

CERTIFICATE OF CORRECTION

PATENT NO. : 4,073,603

DATED : February 14, 1978

INVENTOR(S) : FREDERIC HENRY ABENDSCHEIN, et al

It is certified that error appears in the above-identified patent and that said Letters Patent are hereby corrected as shown below:

Under the provisions of C.F.R. 1.323 the following correction is to be made:

Column 8, line 64, cancel "Claim 2" and insert -- Claim 1 --.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*